US009584942B2

(12) United States Patent
Saltwell

(10) Patent No.: US 9,584,942 B2
(45) Date of Patent: Feb. 28, 2017

(54) DETERMINATION OF HEAD-RELATED TRANSFER FUNCTION DATA FROM USER VOCALIZATION PERCEPTION

(71) Applicant: Microsoft Technology Licensing, LLC, Redmond, WA (US)

(72) Inventor: Erik Saltwell, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 48 days.

(21) Appl. No.: 14/610,975

(22) Filed: Jan. 30, 2015

(65) Prior Publication Data

US 2016/0142848 A1 May 19, 2016

Related U.S. Application Data

(63) Continuation of application No. 14/543,825, filed on Nov. 17, 2014, now abandoned.

(51) Int. Cl.

| | |
|---|---|
| ***H04R 5/00*** | (2006.01) |
| ***H04S 5/00*** | (2006.01) |
| ***H04S 1/00*** | (2006.01) |
| ***H04S 3/00*** | (2006.01) |

(52) U.S. Cl.

CPC ..... *H04S 5/00* (2013.01); *H04S 1/002* (2013.01); *H04S 3/004* (2013.01); *H04S 2420/01* (2013.01)

(58) Field of Classification Search

CPC ..... H04S 2420/01; H04S 5/00; H04S 7/30; H04S 1/002; H04S 3/004

See application file for complete search history.

(56) References Cited

U.S. PATENT DOCUMENTS

| | | | | |
|---|---|---|---|---|
| 5,622,172 | A | 4/1997 | Li et al. | |
| 6,181,800 | B1 | 1/2001 | Lambrecht | |
| 8,326,628 | B2 | 12/2012 | Goldstein et al. | |
| 8,335,331 | B2 | 12/2012 | Johnston et al. | |
| 2012/0078399 | A1 | 3/2012 | Kosaka et al. | |
| 2012/0093320 | A1* | 4/2012 | Flaks | A63F 13/54 381/17 |
| 2012/0201405 | A1* | 8/2012 | Slamka | H04S 7/306 381/307 |
| 2013/0041648 | A1* | 2/2013 | Osman | H04S 7/302 704/2 |

OTHER PUBLICATIONS

U.S. Appl. No. 14/265,154 of Thomas, M., et al. filed Apr. 29, 2014.

(Continued)

*Primary Examiner* — Regina N Holder

(74) *Attorney, Agent, or Firm* — Micah P. Goldsmith; Judy Yee; Micky Minhas

(57) ABSTRACT

A method and apparatus are disclosed to determine individualized head-related transfer function (HRTF) parameters for a user. The technique can include determining HRTF data of a user by using transform data of the user, where the transform data is indicative of a difference, as perceived by the user, between a sound of a direct utterance by the user and a sound of an indirect utterance by the user. The technique may further involve producing an audio effect tailored for the user by processing audio data based on the HRTF data of the user.

18 Claims, 6 Drawing Sheets

(56) References Cited

OTHER PUBLICATIONS

Amani, R., "Introduction to HRTFs", University of Maryland, Retrieved on: Oct. 23, 2014, http://www.umiacs.umd.edu/users/ramani.
"International Search Report & Written Opinion Issued in PCT Application No. PCT/US2015/060781", Mailed Date: Feb. 3, 2016, 12 Pages.
Reinfeldt, et al., "Hearing One's Own Voice During Phoneme Vocalization—Transmission by Air and Bone Conduction", In the Journal of the Acoustical Society of America, vol. 128, Issue 2, Aug. 1, 2010, pp. 751-762.
Yadav, et al., "A System for Simulating Room Acoustical Environments for One's Own Voice", In Journal of Applied Acoustics, vol. 73, Issue 4, Oct. 4, 2011, pp. 409-414.
"International Preliminary Report on Patentability issued in PCT Application No. PCT/US2015/060781," Mailed Date: Oct. 11, 2016, 12 pages.

* cited by examiner

DETERMINATION OF HEAD-RELATED TRANSFER FUNCTION DATA FROM USER VOCALIZATION PERCEPTION

This is a continuation of U.S. patent application Ser. No. 14/543,825, filed on Nov. 17, 2014, which is incorporated herein by reference in its entirety.

FIELD OF THE INVENTION

At least one embodiment of the present invention pertains to techniques for determining Head-Related Transfer Function (HRTF) data, and more particularly, to a method and apparatus for determining HRTF data from user vocalization perception.

BACKGROUND

Three-dimensional (3D) positional audio is a technique for producing sound (e.g., from stereo speakers or a headset) so that a listener perceives the sound to be coming from a specific location in space relative to his or her head. To create that perception an audio system generally uses a signal transformation called a Head-Related Transfer Function (HRTF) to modify an audio signal. An HRTF characterizes how an ear of a particular person receives sound from a point in space. More specifically, an HRTF can be defined as a specific person's left or right ear far-field frequency response, as measured from a specific point in the free field to a specific point in the ear canal.

The highest quality HRTFs are parameterized for each individual listener to account for individual differences in the physiology and anatomy of the auditory system of different listeners. However, current techniques for determining an HRTF are either too generic (e.g., they create an HRTF that is not sufficiently individualized for any given listener) or are too laborious for a listener to make implementation on a consumer scale practical (for example, one would not expect consumers to be willing to come to a research lab to have their personalized HRTFs determined, just so that they can use a particular 3D positional audio product.

SUMMARY

Introduced here is are a method and apparatus (collectively and individually, "the technique") that make it easier to create personalized HRTF data in a way that is easy for a user to self-administer. In at least some embodiments the technique includes determining HRTF data of a user by using transform data of the user, where the transform data is indicative of a difference, as perceived by the user, between a sound of a direct utterance by the user and a sound of an indirect utterance by the user (e.g., as recorded and output from an audio speaker). The technique may further involve producing an audio effect tailored for the user by processing audio data based on the HRTF data of the user. Other aspects of the technique will be apparent from the accompanying figures and detailed description.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

One or more embodiments of the present invention are illustrated by way of example and not limitation in the figures of the accompanying drawings, in which like references indicate similar elements.

DETAILED DESCRIPTION

Figure 1:
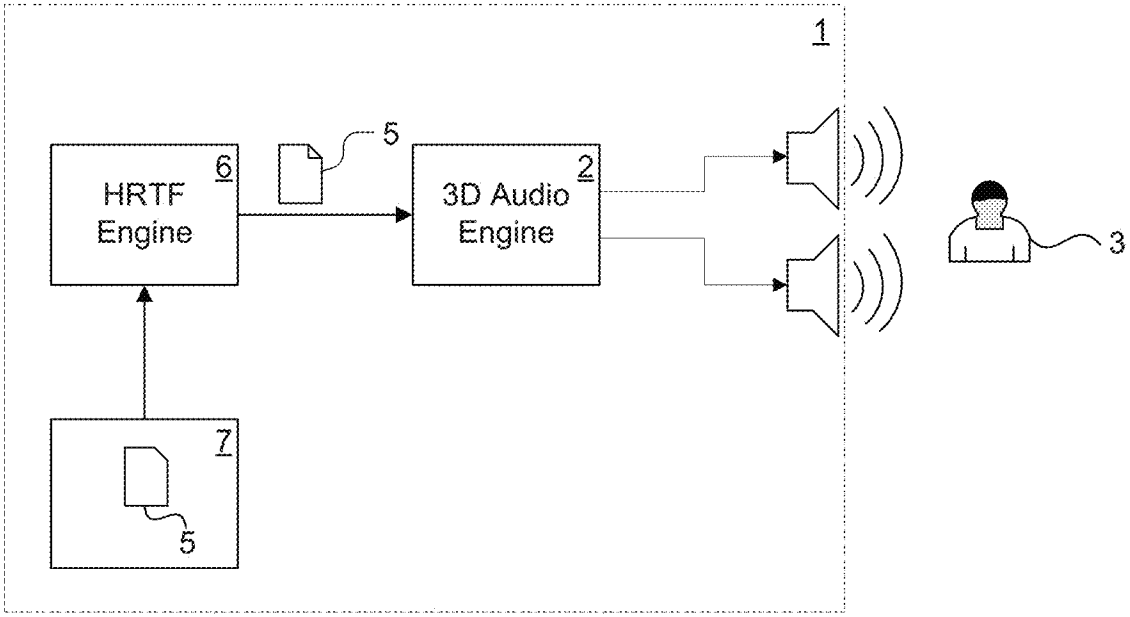
FIG. 1 illustrates an end user device that produces 3D positional audio using personalized HRTF data.

At least two problems are associated with producing a personalized HRTF for a given listener. First, the solution space of potential HRTFs is very large. Second, there is no simple relationship between an HRTF and perceived sound location, so a listener cannot be guided to finding the correct HRTF by simply describing errors in the position of the sound (e.g., by saying, "It's a little too far to the left"). On the other hand, most people have had the experience of listening to a recording of their own voice and noticing that it sounds different from their perception of their directly spoken voice. In other words, a person's voice sounds different to him when he is speaking than when he hears a recording of it.

A principal reason for this perceived difference is that when a person speaks, much of the sound of his voice reaches the eardrum through the head/skull rather than going out from the mouth, through the ear canal and then to the eardrum. With recorded speech, the sound comes to the eardrum almost entirely through the outer ear and ear canal. The outer ear contains many folds and undulations that affect both the timing of the sound (when the sound is registered by the auditory nerve) and its other characteristics, such as pitch, timbre, etc. These features affect how a person perceives sound. In other words, one of the principal determinants of the difference between a person's perception of a direct utterance and an external (e.g., recorded) utterance by the person is the shape of the ears.

These same differences in ear shape between people also determine individualized HRTFs. Consequently, a person's perception of the difference between his internal speech and external speech as a source of data can be used to determine an HRTF for a specific user. That is, a person's perception of the difference between a direct utterance by the person and an indirect utterance by the person can be used to generate a personalized HRTF for that person. Other variables, such as skull/jaw shape or bone density, generate noise in this system and may decrease overall accuracy, because they tend to affect how people perceive the difference between internal and external utterances, without being related to the optimal HRTF for that user. Ear shape, however, is a large enough component of the perceived difference between internal and external utterances that the signal-to-noise ratio should be high enough that the system is still generally usable even with the presence of these other variables as a source of noise.

The term "direct utterance," as used herein, means an utterance by a person from the person's own mouth, i.e., not generated, modified, reproduced, aided, or conveyed by any medium outside the person's body, other than air. Other terms that have the same meaning as "direct utterance" herein include "internal utterance," "intra-cranial utterance," and "internal utterance." On the other hand, the term "indirect utterance," as used herein, means an utterance other than a direct utterance, such as the sound output from a speaker of a recording of an utterance by the person. Other terms for indirect utterance include "external utterance" and "reproduced utterance." Additionally, other terms for "utterance" include "voice," "vocalization," and "speech."

Hence, to determine the best HRTF for a person, one can ask the person to manipulate appropriate audio parameters of his recorded speech to make his direct and indirect utterances sound the same to that person, rather than trying to ask him to help find the correct HRTF parameters directly. Recognition of this fact is valuable, because most people have much more familiarity with differences in sound qualities (e.g., timbre and pitch) than they have with complex mathematical functions (e.g., HRTFs). This familiarity can be used to create a guided experience in which a person helps direct a processing system through a solution space of sound changes (pitch, timbre, etc.) in ways that cannot be done directly with 3D positioning of sound.

At least one embodiment of the technique introduced here, therefore, includes three stages. The first stage involves building a model database, based on interactions with a (preferably large) number of people (training subjects), indicating how different alterations to their external voice sounds (i.e., alterations that make the sound of their external voice be perceived as the same as their internal voice) map to their HRTF data. This mapping is referred to herein as an "equivalence map." The remaining stages are typically performed at a different location from, and at a time well after, the first stage. The second stage involves guiding a particular person (e.g., the end user of a particular consumer product, called "user" herein) through a process of identifying a transform that makes his internal and external voice utterances, as perceived by that person, sound equivalent. The third stage involves using the equivalence map and the individual sound transform generated in the second stage to determine personalized HRTF data for that user. Once the personalized HRTF data is determined, it can be used in an end user product to generate high quality 3D positional audio for that user.

Refer now to FIG. 1, which illustrates an end-user device 1 that produces 3D positional audio using personalized HRTF data. The user device 1 can be, for example, a conventional personal computer (PC), tablet or phablet computer, smartphone, game console, set-top box, or any other processing device. Alternatively, the various elements illustrated in FIG. 1 can be distributed between two or more end-user devices such as any of those mentioned above.

The end-user device 1 includes a 3D audio engine 2 that can generate 3D positional sound for a user 3 through two or more audio speakers 4. The 3D audio engine 2 can include and/or execute a software application for this purpose, such as a game or high-fidelity music application. The 3D audio engine 2 generates positional audio effect by using HRTF data 5 personalized for the user. The personalized HRTF data 5 is generated and provided by an HRTF engine 6 (discussed further below) and stored in a memory 7.

In some embodiments, the HRTF engine 6 may reside in a device other than that which contains the speakers 4. Hence, the end-user device 1 can actually be a multi-device system. For example, in some embodiments, the HRTF engine 6 resides in a video game console (e.g., of the type that uses a high-definition television set as a display device) while the 3D audio engine 2 and speakers 4 reside in a stereo headset worn by the user, that receives the HRTF 5 (and possibly other data) wirelessly from the game console. In that case, both the game console and the headset may include appropriate transceivers (not shown) for providing wired and/or wireless communication between these two devices. Further, the game console in such an embodiment may acquire the personalized HRTF data 5 from a remote device, such as a server computer, for example, via a network such as the Internet. Additionally, the headset in such an embodiment may further be equipped with processing and display elements (not shown) that provide the user with a virtual reality and/or augmented reality ("VR/AR") visual experience, which may be synchronized or otherwise coordinated with the 3D positional audio output of the speakers.

Figure 2:
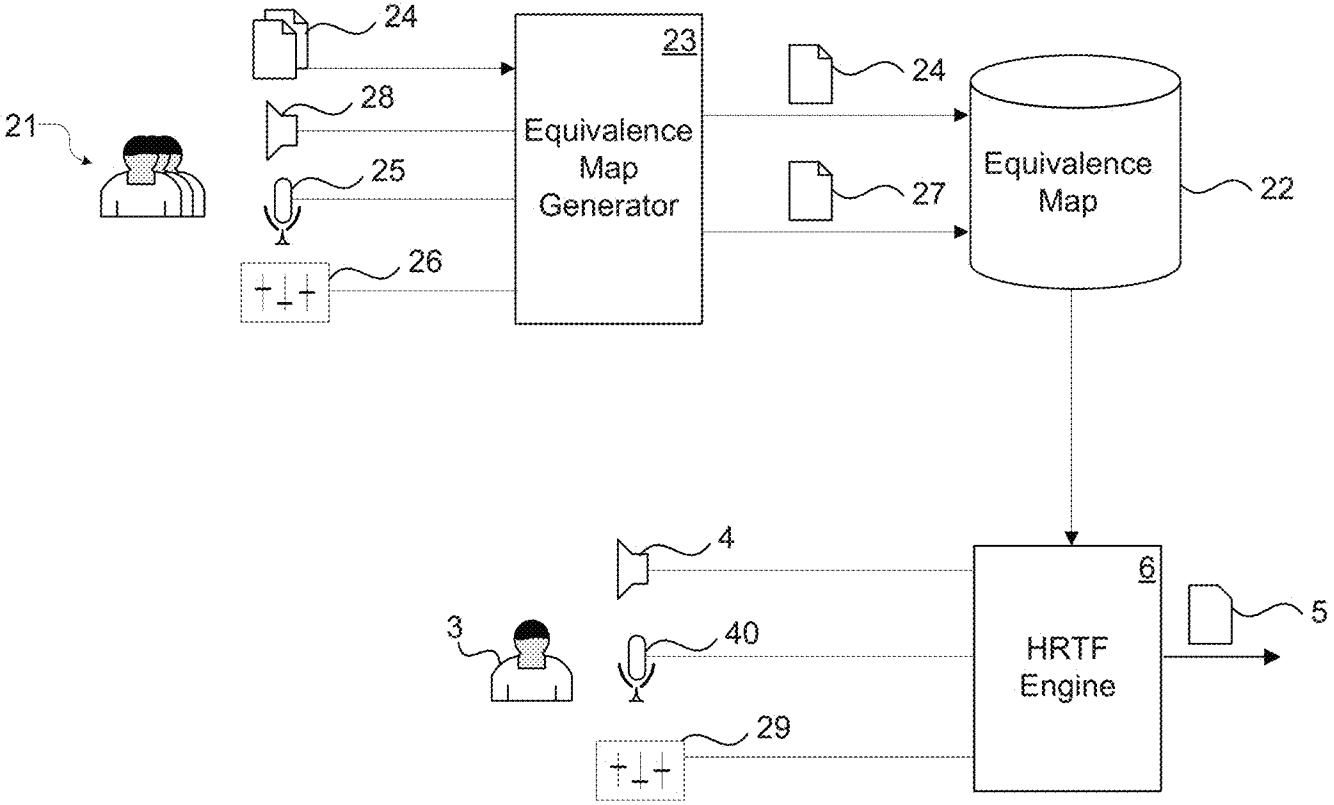
FIG. 2 shows an example of a scheme for generating personalized HRTF data based on user vocalization perception.

FIG. 2 shows an example of a scheme for generating the personalized HRTF data 5, according to some embodiments. A number of people ("training subjects") 21 are guided through a process of creating an equivalence map 22, by an equivalence map generator 23. Initially, HRTF data 24 for each of the training subjects 21 is provided to the equivalence map generator 23. The HRTF data 24 for each training subject 21 can be determined using any known or convenient method and can be provided to the equivalence map generator 23 in any known or convenient format. The manner in which the HRTF data 24 is generated and formatted is not germane to the technique introduced here. Nonetheless, it is noted that known ways of acquiring HRTF data for a particular person include mathematical computation approaches and experimental measurement approaches. In an experimental measurement approach, for example, a person can be placed in an anechoic chamber with a number of audio speakers spaced at equal, known angular displacements (called azimuth) around the person, several feet away from the person (alternatively, a single audio speaker can be used and successively placed at different angular positions, or "azimuths," relative to the person's head). Small microphones can be placed in the person's ear canals and used to detect the sound from each of the speakers successively, for each year. The differences between the sound output by each speaker and the sound detected at the microphones can be used to determine a separate HRTF for the person's left and right ears, for each azimuth.

Known ways of representing an HRTF include, for example, frequency domain representation, time domain representation and spatial domain representation. In a frequency domain HRTF representation, a person's HRTF for each ear can be represented as, for example, a plot (or equivalent data structure) of signal magnitude response versus frequency, for each of multiple azimuth angles, where azimuth is the angular displacement of the sound source in a horizontal plane. In a time domain HRTF representation, a person's HRTF for each ear can be represented as, for example, a plot (or equivalent data structure) of signal amplitude versus time (e.g., sample number), for each of multiple azimuth angles. In a spatial domain HRTF representation, a person's HRTF for each ear can be represented as, for example, a plot (or equivalent data structure) of signal magnitude versus both azimuth angle and elevation angle, for each of multiple azimuths and elevation angles.

Referring again to FIG. 2, for each training subject 21, the equivalence map generator 23 prompts the training subject 21 to speak a predetermined utterance into a microphone 25 and records the utterance. The equivalence map generator 23 then plays back the utterance through one or more speakers 28 to the training subject 21 and prompts the training subject 21 to indicate whether the playback of recorded utterance (i.e., his indirect utterance) sounds the same as his direct utterance. The training subject 21 can provide this indication through any known or convenient user interface, such as via a graphical user interface on a computer's display, mechanical controls (e.g., physical knobs or sliders), or speech recognition interface. If the training subject 21 indicates that the direct and indirect utterances do not sound the same, the equivalence map generator 23 prompts the training subject 21 to make an adjustment to one or more audio parameters (e.g., pitch, timbre or volume), through a user interface 26. As with the aforementioned indication, the user interface 26 can be, for example, a GUI, manual controls, the recognition interface, or a combination thereof. The equivalence map generator 23 then replays the indirect utterance of the training subject 21, modified according to the adjusted audio parameter(s), and again asks the training subject 21 to indicate whether it sounds the same as the training subject's direct utterance. This process continues and repeats if necessary as until the training subject 21 indicates that his direct and indirect utterances sound the same. When the training subject has so indicated, the equivalence map generator 23 then takes the current values of all of the adjustable audio parameters as the training subject's transform data 27, and stores the training subject's transform data 27 in association with the training subject's HRTF data 24 in the equivalence map 22.

The format of the equivalence map 22 is not important, as long as it contains associations between transform data (e.g., audio parameter values) 27 and HRTF data 24 for multiple training subjects. For example, the data can be stored as key-value pairs, where the transform data are the keys and HRTF data are the corresponding values. Once complete, the equivalence map 22 may, but does not necessarily, preserve the data association for each individual training subject. For example, at some point the equivalence map generator 23 or some other entity may process the equivalence map 22 so that a given set of HRTF data 24 is no longer associated with one particular training subject 21; however, that set of HRTF data would still be associated with a particular set of transform data 27.

At some time after the equivalence map 22 has been created, it can be stored in, or made accessible to, an end-user product, for use in generating personalized 3D positional audio as described above. For example, the equivalence map 22 may be incorporated into an end-user product by the manufacturer of the end-user product. Alternatively, it may be downloaded to an end-user product via a computer network (e.g., the Internet) at some time after manufacture and sale of the end-user product, such as after the user has taken delivery of the product. In yet another alternative, the equivalence map 22 may simply be made accessible to end-user product via a network (e.g., the Internet), without ever downloading any substantial portion of the equivalence map to the end-user product.

Referring still to FIG. 2, the HRTF engine 6, which is implemented in or at least in communication with an end-user product, has access to the equivalence map 22. The HRTF engine 6 guides the user 3 through a process similar to that which the training subjects 21 were guided through. In particular, the HRTF engine 6 prompts the user to speak a predetermined utterance into a microphone 40 (which may be part of the end user product) and records the utterance. The HRTF engine 6 then plays back the utterance through one or more speakers 4 (which also may be part of the end user product) to the user 3 and prompts the user 3 to indicate whether the playback of recorded utterance (i.e., his indirect utterance) sounds the same as his direct utterance. The user 3 can provide this indication through any known or convenient user interface, such as via a graphical user interface on a computer's display or a television, mechanical controls (e.g., physical knobs or sliders), or a speech recognition interface. Note that in other embodiments, these steps may be reversed; for example, the user may be played a previously recorded version of his own voice and then asked to speak and listen to his direct utterance and compare it to the recorded version.

If the user 3 indicates that the direct and indirect utterances do not sound the same, the HRTF engine 6 prompts the user 3 to make an adjustment to one or more audio parameters (e.g., pitch, timbre or volume), through a user interface 29. As with the aforementioned indication, the user interface 29 can be, for example, a GUI, manual controls, speech recognition interface, or a combination thereof. The HRTF engine 6 then replays the indirect utterance of the user 3, modified according to the adjusted audio parameter(s), and again asks the user 3 to indicate whether it sounds the same as the user's direct utterance. This process continues and repeats if necessary as until the user 3 indicates that his direct and indirect utterances sound the same. When the user 3 has so indicated, the HRTF engine 6 then takes the current values of the adjustable audio parameters to be the user's transform data. At this point, the HRTF engine 6 then uses the user's transform data to index into the equivalence map 22, to determine the HRTF data stored therein that is most appropriate for the user 3. This determination of personalized HRTF data can be a simple lookup operation. Alternatively, it may involve a best fit determination, which can include one or more techniques, such as machine learning or statistical techniques. Once the personalized HRTF data is determined for the user 3, it can be provided to a 3D audio engine in the end-user product, for use in generating 3D positional audio, as described above.

The equivalence map generator 23 and the HRTF engine 6 each can be implemented by, for example, one or more general-purpose microprocessors programmed (e.g., with a software application) to perform the functions described herein. Alternatively, these elements can be implemented by special-purpose circuitry, such as application-specific integrated circuits (ASICs), programmable logic devices (PLDs), field programmable gate arrays (FPGAs), or the like.

Figure 3:
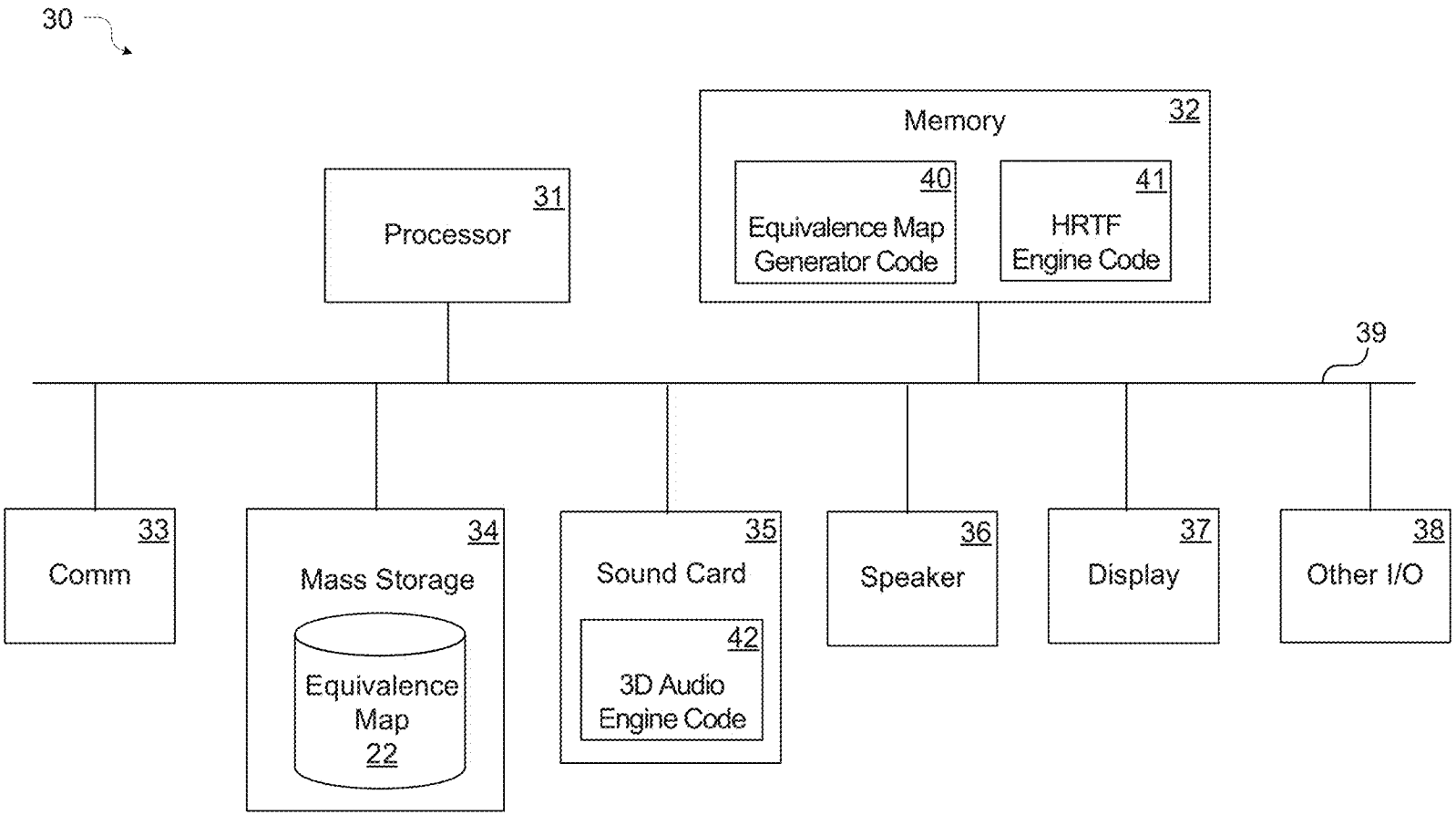
FIG. 3 is a block diagram of an example of a processing system in which the personalized HRTF generation technique can be implemented.

FIG. 3 illustrates at a high level an example of a processing system in which the personalized HRTF generation technique introduced here can be implemented. Note that different portions of the technique can be implemented in two or more separate processing systems, each consistent with that represented in FIG. 3. The processing system 30 can represent an end-user device, such as end-user device 1 in FIG. 1, or a device that generates an equivalence map used by an end-user device.

As shown, the processing system 30 includes one or more processors 31, memories 32, communication devices 33, mass storage devices 34, sound card 35, audio speakers 36, display devices 37, and possibly other input/output (I/O) devices 38, all coupled to each other through some form of interconnect 39. The interconnect 39 may be or include one or more conductive traces, buses, point-to-point connections, controllers, adapters, wireless links and/or other conventional connection devices and/or media. The one or more processors 31 individually and/or collectively control the overall operation of the processing system 30 and can be or include, for example, one or more general-purpose programmable microprocessors, digital signal processors (DSPs), mobile application processors, microcontrollers, application specific integrated circuits (ASICs), programmable gate arrays (PGAs), or the like, or a combination of such devices.

The one or more memories 32 each can be or include one or more physical storage devices, which may be in the form of random access memory (RAM), read-only memory (ROM) (which may be erasable and programmable), flash memory, miniature hard disk drive, or other suitable type of storage device, or a combination of such devices. The one or more mass storage devices 34 can be or include one or more hard drives, digital versatile disks (DVDs), flash memories, or the like.

The one or more communication devices 33 each may be or include, for example, an Ethernet adapter, cable modem, DSL modem, Wi-Fi adapter, cellular transceiver (e.g., 3G, LTE/4G or 5G), baseband processor, Bluetooth or Bluetooth Low Energy (BLE) transceiver, or the like, or a combination thereof.

Data and instructions (code) that configure the processor(s) 31 to execute aspects of the technique introduced here can be stored in one or more components of the system 30, such as in memories 32, mass storage devices 34 or sound card 35, or a combination thereof. For example, as shown in the FIG. 3, in some embodiments the equivalence map 22 is stored in a mass storage device 34, and the memory 32 stores code 40 for implementing the equivalence map generator 23 and code 41 for implementing the HRTF engine 6 and code 41 for implementing the 3D audio engine 2 (i.e., when executed by a processor 31). The sound card 35 may include the 3D audio engine 2 and/or memory storing code 42 for implementing the 3D audio engine 2 (i.e., when executed by a processor). As mentioned above, however, these elements (code and/or hardware) do not have to all reside in the same device, and other possible ways of distributing them are possible. Further, in some embodiments, two or more of the illustrated components can be combined; for example, the functionality of the sound card 35 may be implemented by one or more of the processors 31, possibly in conjunction with one or more memories 32.

Figure 4:
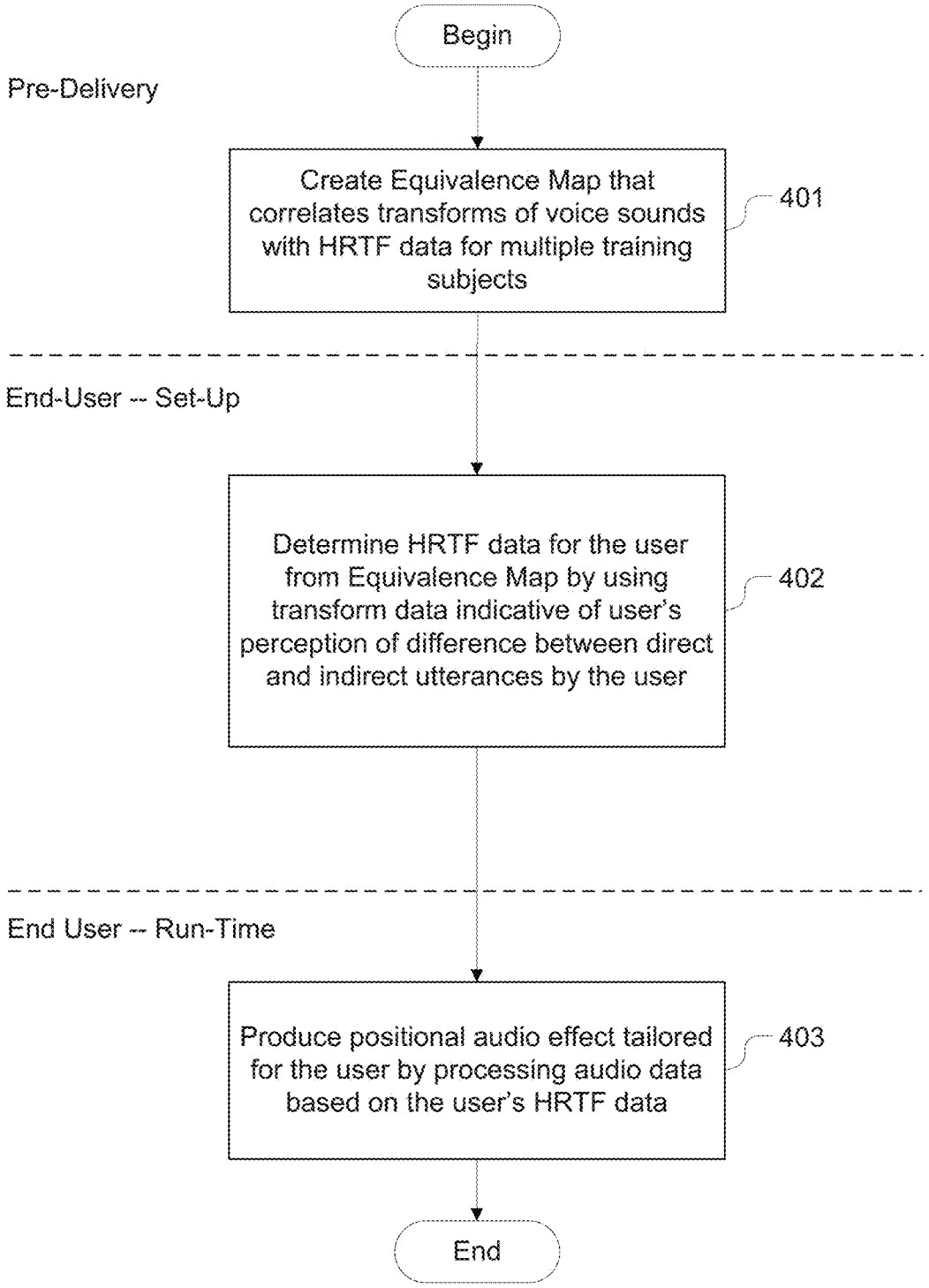
FIG. 4 is a flow diagram of an example of an overall process for generating and using personalized HRTF data based on user vocalization perception.

FIG. 4 shows an example of an overall process for generating and using personalized HRTF data based on user vocalization perception. Initially, at step 401, an equivalence map is created, that correlates transforms of voice sounds with HRTF data of multiple training subjects. Subsequently (potentially much later, and presumably at a different location than where step 401 was performed), at step 402, HRTF data for a particular user is determined from the equivalence map, for example, by using transform data indicative of the user's perception of the difference between a direct utterance by the user and an indirect utterance by the user as an index into the equivalence map. Finally, at step 403, a positional audio effect tailored for the user is produced, by processing audio data based on the user's personalized HRTF data determined in step 402.

Figure 5:
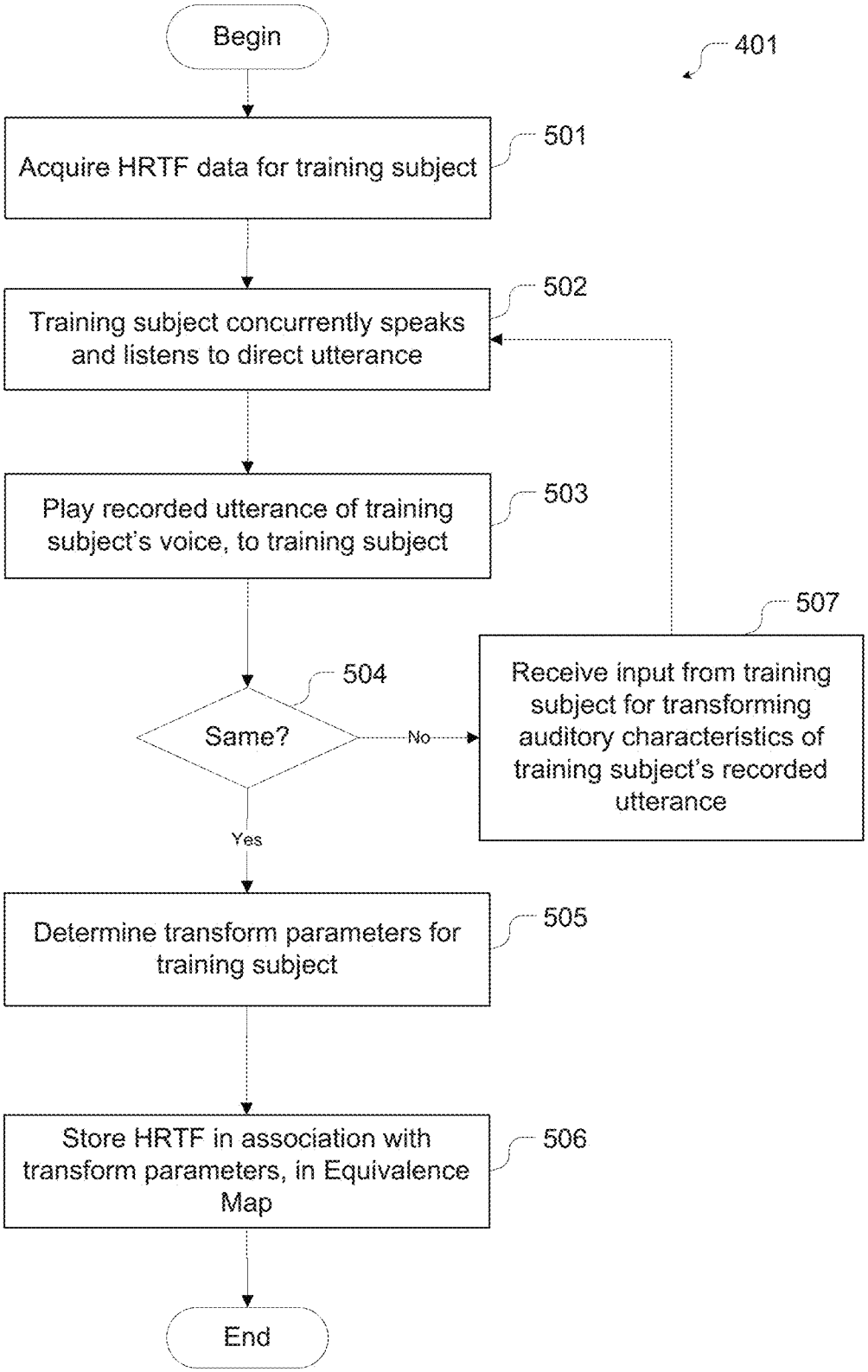
FIG. 5 is a flow diagram of an example of an overall process for creating an equivalence map.

FIG. 5 illustrates in greater detail an example of the step 401 of creating the equivalence map, according to some embodiments. The process can be performed by an equivalence map generator, such as equivalence map generator 23 in FIG. 2, for example. The illustrated process is repeated for each of multiple (ideally a large number of) training subjects.

Initially, the process of FIG. 2 acquires HRTF data of a training subject. As mentioned above, any known or convenient technique for generating or acquiring HRTF data can be used in this step. Next, at step 502 the training subject concurrently speaks and listens to his own direct utterance, which in the current example embodiment is also recorded by the system (e.g., by the equivalence map generator 23). The content of the utterance is unimportant; it can be any convenient test phrase, such as, "Testing 1-2-3, my name is John Doe." Next, at step 503 the process plays to the training subject an indirect utterance of the training subject (e.g., the recording of the user's utterance in step 502), through one or more audio speakers. The training subject then indicates at step 504 whether the indirect utterance of step 503 sounded the same to him as the direct utterance of step 502. Note that the ordering of steps in this entire process can be altered from what is described here. For example, in other embodiments the system may first play back a previously recorded utterance of the training subject and thereafter ask the training subject to speak and listen to his direct utterance.

If the training subject indicates that the direct and indirect utterances do not sound the same, then the process at step 507 receives input from the training subject for transforming auditory characteristics of his indirect (recorded) utterance. These inputs can be provided by, for example, the training subject turning one or more control knobs and/or moving one or more sliders, each corresponding to a different audio parameter (e.g., pitch, timbre or volume), any of which may be a physical control or a software-based control. The process then repeats from step 502, by playing the recorded utterance again, modified according to the parameters as adjusted in step 507.

When the training subject indicates in step 504 that the direct and indirect utterance sound "the same" (which in practical terms may mean as close as the training subject is able to get them to sound), the process proceeds to step 505, in which the process determines the transform parameters for the training subject to be the current values of the audio parameters, i.e., as most recently modified by the training subject. These values are then stored in the equivalence map in association with the training subject's HRTF data at step 506.

It is possible to create or refine the equivalence map by using deterministic statistical regression analysis or through more sophisticated, non-deterministic machine learning techniques, such as neural networks or decision trees. These techniques can be applied after the HRTF data and transform data from all of the training subjects have been acquired and stored, or they can be applied to the equivalence map iteratively as new data is acquired and stored in the equivalence map.

Figure 6:
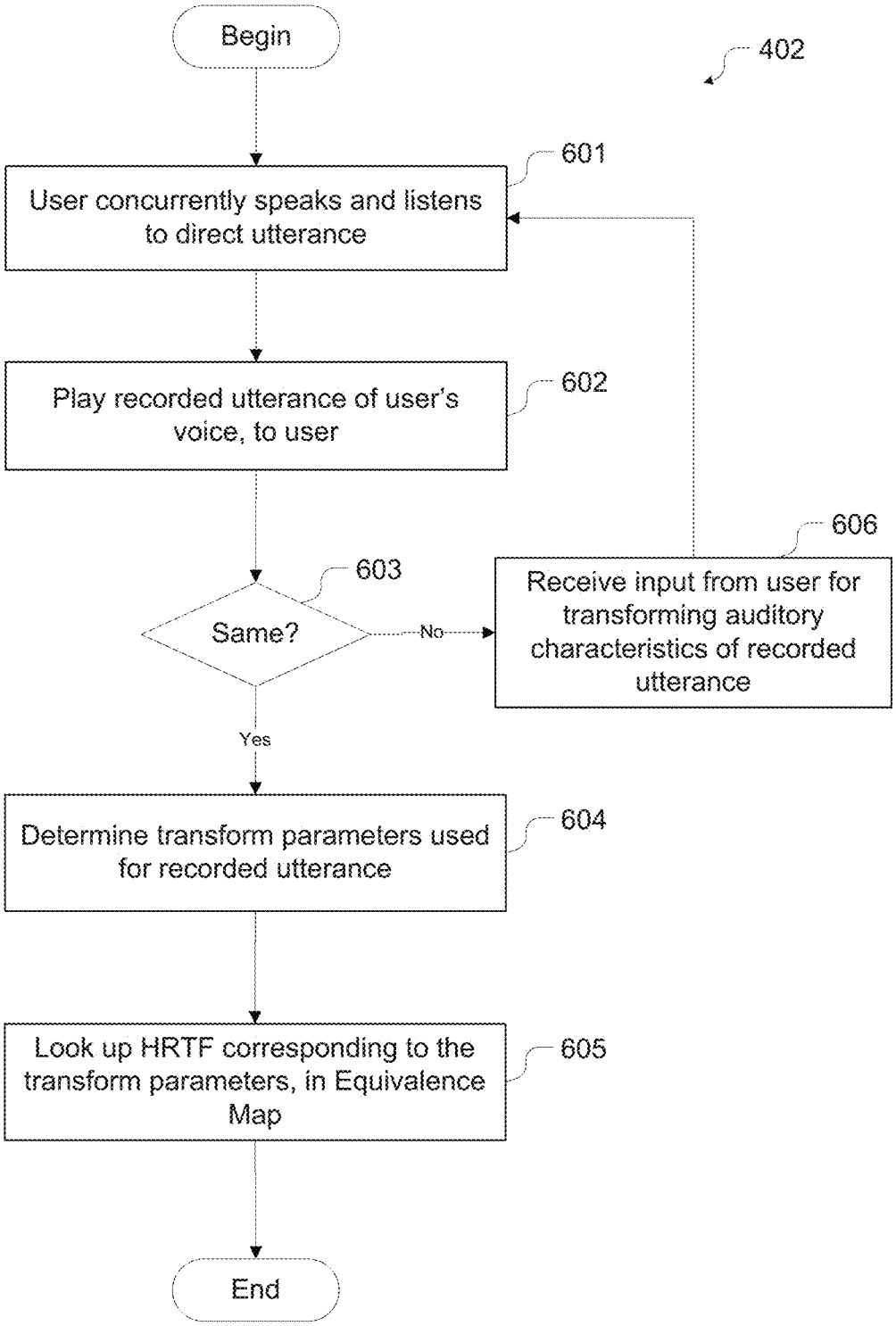
FIG. 6 is a flow diagram of an example of an overall process for determining personalized HRTF data of a user based on an equivalence map and transform data of the user.

FIG. 6 shows in greater detail an example of the step 402 of determining personalized HRTF data of a user, based on an equivalence map and transform data of the user, according to some embodiments. The process can be performed by an HRTF engine, such as HRTF engine 6 in FIGS. 1 and 2, for example. Initially, at step 601 the user concurrently speaks and listens to his own direct utterance, which in the current example embodiment is also recorded by the system (e.g., by the HRTF engine 6). The content of the utterance is unimportant; it can be any convenient test phrase, such as, "Testing 1-2-3, my name is Joe Smith." Next, at step 602 the process plays to the user an indirect utterance of the user (e.g., the recording of the user's utterance in step 601), through one or more audio speakers. The training subject then indicates at step 603 whether the indirect utterance of step 602 sounded the same to him as the direct utterance of step 601. Note that the ordering of steps in this entire process can be altered from what is described here. For example, in other embodiments the system may first play back a previously recorded utterance of the user and thereafter ask the user to speak and listen to his direct utterance.

If the user indicates that the direct and indirect utterances do not sound the same, the process then at step 606 receives input from the user for transforming auditory characteristics of his indirect (recorded) utterance. These inputs can be provided by, for example, the user turning one or more control knobs and/or moving one or more sliders, each corresponding to a different audio parameter (e.g., pitch, timbre or volume), any of which may be a physical control or a software-based control. The process then repeats from step 601, by playing the recorded utterance again, modified according to the parameters as adjusted in step 606.

When the user indicates in step 603 that the direct and indirect utterance sound the same (which in practical terms may mean as close as the user is able to get them to sound), the process proceeds to step 604, in which the process determines the transform parameters for the user to be the current values of the audio parameters, i.e., as most recently modified by the user. These values are then used to perform a look-up in the equivalence map (or to perform a best fit analysis) of the HRTF data that corresponds most closely to the user's transform parameters; that HRTF data is then taken as the user's personalized HRTF data. As in the process of FIG. 5, it is possible to use deterministic statistical regression analysis or more sophisticated, non-deterministic machine learning techniques (e.g., neural networks or decision trees) to determine the HRTF data that most closely maps to the user's transform parameters.

Note that other variations upon the above described processes are contemplated. For example, rather than having the training subject or user adjust the audio parameters themselves, some embodiments may instead present the training subject or user with an array of differently altered external voice sounds and have them pick the one that most closely matches their perception of their internal voice sound, or guide the system by indicating more or less similar with each presented external voice sound.

The machine-implemented operations described above can be implemented by programmable circuitry programmed/configured by software and/or firmware, or entirely by special-purpose circuitry, or by a combination of such forms. Such special-purpose circuitry (if any) can be in the form of, for example, one or more application-specific integrated circuits (ASICs), programmable logic devices (PLDs), field-programmable gate arrays (FPGAs), system-on-a-chip systems (SOCs), etc.

Software to implement the techniques introduced here may be stored on a machine-readable storage medium and may be executed by one or more general-purpose or special-purpose programmable microprocessors. A "machine-readable medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible medium includes recordable/non-recordable media (e.g., read-only memory (ROM); random access memory (RAM); magnetic disk storage media; optical storage media; flash memory devices; etc.), etc.

Examples of Certain Embodiments

Certain embodiments of the technology introduced herein are summarized in the following numbered examples:

1. A method including: determining head related transform function (HRTF) data of a user by using transform data of the user, the transform data being indicative of a difference, as perceived by the user, between a sound of a direct utterance by the user and a sound of an indirect utterance by the user; and producing an audio effect tailored for the user by processing audio data based on the HRTF data of the user.

2. A method as recited in example 1, further including, prior to determining the HRTF data of the user: receiving user input from the user via a user interface, the user input being indicative of the difference, as perceived by the user, between the sound of the direct utterance by the user and the sound of an indirect utterance by the user output from an audio speaker; and generating the transform data of the user based on the user input.

3. A method as recited in any of the preceding examples 1 through 2, wherein determining the HRTF data of the user includes determining a closest match for the transform data of the user, in a mapping database that contains an association of HRTF data of a plurality of training subjects with transform data of the plurality of training subjects.

4. A method as recited in any of the preceding examples 1 through 3, wherein the transform data of the plurality of training subjects is indicative of a difference, as perceived by each corresponding training subject, between a sound of a direct utterance by the training subject and a sound of an indirect utterance by the training subject output from an audio speaker.

5. A method as recited in any of the preceding examples 1 through 4, wherein determining the closest match for the transform data of the user in the mapping database includes executing a machine-learning algorithm to determine the closest match.

6. A method as recited in any of the preceding examples 1 through 5, wherein determining the closest match for the transform data of the user in the mapping database includes executing a statistical algorithm to determine the closest match.

7. A method including: a) playing, to a user, a reproduced utterance of the user, through an audio speaker; b) prompting the user to provide first user input indicative of whether the user perceives a sound of the reproduced utterance to be the same as a sound of a direct utterance by the user; c) receiving the first user input from the user; d) when the first user input indicates that the user perceives the sound of the reproduced utterance to be different from the sound of the direct utterance, enabling the user to provide second user input, via a user interface, for causing an adjustment to an audio parameter, and then repeating steps a) though d) using the reproduced utterance adjusted according to the second user input, until the user indicates that the sound of the reproduced utterance is the same as the sound of the direct utterance; e) determining transform data of the user based on the adjusted audio parameter when the user has indicated that the sound of the reproduced utterance is the substantially same as the sound of the direct utterance; and f) determining head related transform function (HRTF) data of the user by using the transform data of the user and a mapping database that contains transform data of a plurality of training subjects associated with HRTF data of the plurality of training subjects.

8. A method as recited in example 7, further including: producing, via the audio speaker, a positional audio effect tailored for the user, by processing audio data based on the HRTF data of the user.

9. A method as recited in any of the preceding examples 7 through 8, wherein transform data of the plurality of training subjects in the mapping database is indicative of a difference, as perceived by each corresponding training subject, between a sound of a direct utterance by the training subject and a sound of a reproduced utterance by the training subject output from an audio speaker.

10. A method as recited in any of the preceding examples 7 through 9, wherein determining HRTF data of the user includes executing a machine-learning algorithm.

11. A method as recited in any of the preceding examples 7 through 10, wherein determining HRTF data of the user includes executing a statistical algorithm.

12. A processing system including: a processor; and a memory coupled to the processor and storing code that, when executed in the processing system, causes the processing system to: receive user input from a user, the user input representative of a relationship, as perceived by the user, between a sound of a direct utterance by the user and a sound of a reproduced utterance by the user output from an audio speaker; derive transform data of the user based on the user input; use the transform data of the user to determine head related transform function (HRTF) data of the user; and cause the HRTF data to be provided to audio circuitry, for use by the audio circuitry in producing an audio effect tailored for the user based on the HRTF data of the user.

13. A processing system as recited in example 12, wherein the processing system is a headset.

14. A processing system as recited in any of the preceding examples 12 through 13, wherein the processing system is a game console and is configured to transmit the HRTF data to a separate user device that contains the audio circuitry.

15. A processing system as recited in any of the preceding examples 12 through 14, wherein the processing system includes a headset and a game console, the game console including the processor and the memory, the headset including the audio speaker and the audio circuitry.

16. A processing system as recited in any of the preceding examples 12 through 15, wherein the code is further to cause the processing system to: a) cause the reproduced utterance to be played to the user through the audio speaker; b) prompt the user to provide first user input indicative of whether the user perceives the sound of the reproduced utterance to be the same as the sound of the direct utterance; c) receive the first user input from the user; d) when the first user input indicates that the reproduced utterance sounds different from the direct utterance, enable the user to provide second user input, via a user interface, to adjust an audio parameter of the reproduced utterance, and then repeat said a) though d) using the reproduced utterance with the adjusted audio parameter, until the user indicates that the reproduced utterance sounds the same as the direct utterance; and e) determine the transform data of the user based the adjusted audio parameter when the user has indicated that the reproduced utterance sounds substantially the same as the direct utterance.

17. A processing system as recited in any of the preceding examples 12 through 16, wherein the code is further to cause the processing system to determine the HRTF data of the user by determining a closest match for the transform data in a mapping database that contains an association of HRTF data of a plurality of training subjects with transform data of the plurality of training subjects.

18. A processing system as recited in any of the preceding examples 12 through 17, wherein the transform data of the plurality of training subjects is indicative of a difference, as perceived by each corresponding training subject, between a sound of a direct utterance by the training subject and a sound of a reproduced utterance by the training subject output from an audio speaker.

19. A system including: an audio speaker; audio circuitry to drive the audio speaker; and a head related transform function (HRTF) engine, communicatively coupled to the audio circuitry, to determine HRTF data of the user, by deriving transform data of the user indicative of a difference, as perceived by the user, between a sound of a direct utterance by the user and a sound of a reproduced utterance by the user output from the audio speaker, and then using the transform data of the user to determine the HRTF data of the user.

20. An apparatus including: means for determining head related transform function (HRTF) data of a user by using transform data of the user, the transform data being indicative of a difference, as perceived by the user, between a sound of a direct utterance by the user and a sound of an indirect utterance by the user; and means for producing an audio effect tailored for the user by processing audio data based on the HRTF data of the user.

21. An apparatus as recited in example 20, further including, means for receiving, prior to determining the HRTF data of the user, user input from the user via a user interface, the user input being indicative of the difference, as perceived by the user, between the sound of the direct utterance by the user and the sound of an indirect utterance by the user output from an audio speaker; and means for generating, prior to determining the HRTF data of the user, the transform data of the user based on the user input.

22. An apparatus as recited in any of the preceding examples 20 through 21, wherein determining the HRTF data of the user includes determining a closest match for the transform data of the user, in a mapping database that contains an association of HRTF data of a plurality of training subjects with transform data of the plurality of training subjects.

23. An apparatus as recited in any of the preceding examples 20 through 22, wherein the transform data of the plurality of training subjects is indicative of a difference, as perceived by each corresponding training subject, between a sound of a direct utterance by the training subject and a sound of an indirect utterance by the training subject output from an audio speaker.

24. An apparatus as recited in any of the preceding examples 20 through 23, wherein determining the closest match for the transform data of the user in the mapping database includes executing a machine-learning algorithm to determine the closest match.

25. An apparatus as recited in any of the preceding examples 20 through 24, wherein determining the closest match for the transform data of the user in the mapping database includes executing a statistical algorithm to determine the closest match.

Any or all of the features and functions described above can be combined with each other, except to the extent it may be otherwise stated above or to the extent that any such embodiments may be incompatible by virtue of their function or structure, as will be apparent to persons of ordinary skill in the art. Unless contrary to physical possibility, it is envisioned that (i) the methods/steps described herein may be performed in any sequence and/or in any combination, and that (ii) the components of respective embodiments may be combined in any manner.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A method comprising:

determining head related transform function (HRTF) data of a user by using transform data of the user, the transform data being indicative of a difference, as perceived by the user, between a sound of a direct utterance by the user and a sound of an indirect utterance by the user; and producing an audio effect tailored for the user by processing audio data based on the HRTF data of the user.

2. A method as recited in claim 1, further comprising, prior to determining the HRTF data of the user:

receiving user input from the user via a user interface, the user input being indicative of the difference, as perceived by the user, between the sound of the direct utterance by the user and the sound of an indirect utterance by the user output from an audio speaker; and generating the transform data of the user based on the user input.

3. A method as recited in claim 1, wherein determining the HRTF data of the user comprises:

determining a closest match for the transform data of the user, in a mapping database that contains an association of HRTF data of a plurality of training subjects with transform data of the plurality of training subjects.

4. A method as recited in claim 3, wherein the transform data of the plurality of training subjects is indicative of a difference, as perceived by each corresponding training subject, between a sound of a direct utterance by the training subject and a sound of an indirect utterance by the training subject output from an audio speaker.

5. A method as recited in claim 3, wherein determining the closest match for the transform data of the user in the mapping database comprises executing a machine-learning algorithm to determine the closest match.

6. A method as recited in claim 3, wherein determining the closest match for the transform data of the user in the mapping database comprises executing a statistical algorithm to determine the closest match.

7. A method comprising:

a) playing, to a user, a reproduced utterance of the user, through an audio speaker;

b) prompting the user to provide first user input indicative of whether the user perceives a sound of the reproduced utterance to be the same as a sound of a direct utterance by the user;

c) receiving the first user input from the user;

d) when the first user input indicates that the user perceives the sound of the reproduced utterance to be different from the sound of the direct utterance, enabling the user to provide second user input, via a user interface, for causing an adjustment to an audio parameter, and then repeating steps a) though d) using the reproduced utterance adjusted according to the second user input, until the user indicates that the sound of the reproduced utterance is the same as the sound of the direct utterance;

e) determining transform data of the user based on the adjusted audio parameter when the user has indicated that the sound of the reproduced utterance is the substantially same as the sound of the direct utterance; and f) determining head related transform function (HRTF) data of the user by using the transform data of the user and a mapping database that contains transform data of a plurality of training subjects associated with HRTF data of the plurality of training subjects.

8. A method as recited in claim 7, further comprising:

producing, via the audio speaker, a positional audio effect tailored for the user, by processing audio data based on the HRTF data of the user.

9. A method as recited in claim 7, wherein transform data of the plurality of training subjects in the mapping database is indicative of a difference, as perceived by each corresponding training subject, between a sound of a direct utterance by the training subject and a sound of a reproduced utterance by the training subject output from an audio speaker.

10. A method as recited in claim 7, wherein determining HRTF data of the user comprises executing a machine-learning algorithm.

11. A method as recited in claim 7, wherein determining HRTF data of the user comprises executing a statistical algorithm.

12. A processing system comprising:

a processor; and a memory coupled to the processor and storing code that, when executed in the processing system, causes the processing system to:

receive user input from a user, the user input representative of a relationship between a sound of a direct utterance by the user and a sound of a reproduced utterance by the user output from an audio speaker;

derive transform data of the user based on the user input;

use the transform data of the user to determine head related transform function (HRTF) data of the user; and cause the HRTF data to be provided to audio circuitry, for use by the audio circuitry in producing an audio effect tailored for the user based on the HRTF data of the user.

13. A processing system as recited in claim 12, wherein the processing system is a headset.

14. A processing system as recited in claim 12, wherein the processing system is a game console and is configured to transmit the HRTF data to a separate user device that contains the audio circuitry.

15. A processing system as recited in claim 12, wherein the processing system comprises a headset and a game console, the game console including the processor and the memory, the headset including the audio speaker and the audio circuitry.

16. A processing system as recited in claim 12, wherein the code is further to cause the processing system to:

a) cause the reproduced utterance to be played to the user through the audio speaker;

b) prompt the user to provide first user input indicative of whether the user perceives the sound of the reproduced utterance to be the same as the sound of the direct utterance;

c) receive the first user input from the user;

d) when the first user input indicates that the reproduced utterance sounds different from the direct utterance, enable the user to provide second user input, via a user interface, to adjust an audio parameter of the reproduced utterance, and then repeat said a) though d) using the reproduced utterance with the adjusted audio parameter, until the user indicates that the reproduced utterance sounds the same as the direct utterance; and e) determine the transform data of the user based the adjusted audio parameter when the user has indicated that the reproduced utterance sounds substantially the same as the direct utterance.

17. A processing system as recited in claim 12, wherein the code is further to cause the processing system to determine the HRTF data of the user by determining a closest match for the transform data in a mapping database that contains an association of HRTF data of a plurality of training subjects with transform data of the plurality of training subjects.

18. A processing system as recited in claim 17, wherein the transform data of the plurality of training subjects is indicative of a difference, as perceived by each corresponding training subject, between a sound of a direct utterance by the training subject and a sound of a reproduced utterance by the training subject output from an audio speaker.

* * * * *